US006496448B1

(12) United States Patent
Kompanek

(10) Patent No.: US 6,496,448 B1
(45) Date of Patent: Dec. 17, 2002

(54) TRANSDUCER RECEIVING VOLTAGE INPUTS, SUCH AS SQUARE WAVES, RICH IN HARMONICS

(75) Inventor: Harry W. Kompanek, Santa Barbara, CA (US)

(73) Assignee: Piezo Sona-Tool Corporation, Ventura, CA (US)

( * ) Notice: Subject to any disclaimer, the term of this patent is extended or adjusted under 35 U.S.C. 154(b) by 136 days.

(21) Appl. No.: 09/716,849

(22) Filed: Nov. 15, 2000

(51) Int. Cl.[7] ..... H04R 17/00; E21B 28/00
(52) U.S. Cl. ..... 367/157; 166/177.1
(58) Field of Search ..... 367/157; 166/177

(56) References Cited

U.S. PATENT DOCUMENTS 4,345,650 A * 8/1982 Wesley ..... 166/177.2
5,109,922 A * 5/1992 Joseph ..... 166/177.1

* cited by examiner

*Primary Examiner*—Gregory J. Toatley, Jr.
(74) *Attorney, Agent, or Firm*—Fulwider Patton, et al.; Ellsworth R. Roston

(57) ABSTRACT

A transducer member is made from a piezoelectric material (e.g. barium titanium) having a looped configuration and a gap in the loop and having properties of vibrating upon the introduction of an electrical voltage to the transducer member. A support member made from steel or aluminum and having a looped configuration and enveloping, and attached to, the transducer member has a gap aligned with the transducer member tap and has properties of vibrating with the transducer member. The transducer member may have a uniform thickness around its periphery or a progressively increasing thickness with progressive distances from the gap. The transducer has a high mechanical Q (e.g. 8–12) and a particular resonant frequency when disposed in air or in a vacuum. When the transducer is disposed below the earth's surface, its resonant frequency may vary because of variations in the earth's characteristics at the different positions. An alternating voltage having the particular frequency as its fundamental frequency is applied to the transducer member with a particular amplitude. The voltage has harmonics with large amplitudes (as in a squarewave) relative to the particular amplitude. When the transducer member is disposed in the earth, sound pressure waves are produced in the transducer with larger amplitudes at harmonics and overtones of the fundamental frequency over a wide frequency range than the magnitude of the amplitude at the fundamental frequency. The harmonics and overtures produce an enhanced recovery of the oil from the earth regardless of the earth's variable characteristics.

75 Claims, 4 Drawing Sheets

FIG. 3a

| WAVEFORM | FREQUENCY-HERTZ | VOLTAGE | CURRENT | PWR. IN | SOUND METER OUTPUT |
|---|---|---|---|---|---|
| SINE | 200 | 100 | <10ma | <1 WATT | <72 db |
| SQUARE | 200 | 100 | 130ma | 13 WATTS | 93 db |
| SINE | 250 | 100 | 10ma | 1 WATT | <72 db |
| SQUARE | 250 | 100 | 145ma | 14.5 WATTS | 93 db |
| SINE | 400 | 100 | 20ma | 2 WATTS | <72 db |
| SQUARE | 400 | 100 | 185ma | 18.5 WATTS | 97 db |
| SINE | 450 | 100 | 25ma | 2.5 WATTS | <72 db |
| SQUARE | 450 | 100 | 190ma | 19 WATTS | 96 db |
| SINE | 550 | 100 | 25ma | 2.5 WATTS | <72 db |
| SQUARE | 550 | 100 | 220ma | 22 WATTS | 99 db |
| SINE | 600 | 100 | 50ma | 5.0 WATTS | 92 db |
| SQUARE | 600 | 100 | 220ma | 22 WATS | 100 db |
| SINE | 700 | 100 | 50ma | 5.0 WATTS | 84 db |
| SQUARE | 700 | 100 | 245ma | 24.5 WATTS | 106 db |
| SINE | 800 | 100 | 50ma | 5.0 WATTS | 100 db |
| SQUARE | 800 | 100 | 225ma | 22.5 WATTS | 106 db |
| SINE | 900 | 100 | 50ma | 5.0 WATTS | 96 db |
| SQUARE | 900 | 100 | 280ma | 28 WATTS | 108 db |
| SINE | 950 | 100 | 50ma | 5.0 WATTS | 86 db |
| SQUARE | 950 | 100 | 260ma | 26 WATTS | 98 db |

FIG. 3b

| WAVEFORM | FREQUENCY-HERTZ | VOLTAGE | CURRENT | PWR. IN | SOUND METER OUTPUT |
|---|---|---|---|---|---|
| SINE | 600 | 200 | 50ma | 10 watts | 90 db |
| SQUARE | 600 | 200 | 230ma | 46 watts | 99 db |
| SINE | 700 | 200 | 50ma | 10.0 watts | 86 db |
| SQUARE | 700 | 200 | 250ma | 50 watts | 107 db |
| SINE | 800 | 200 | 50ma | 10.0 watts | 102 db |
| SQUARE | 800 | 200 | 240ma | 48 watts | 106 db |
| SINE | 900 | 200 | 50ma | 10 watts | 98 db |
| SQUARE | 900 | 200 | 285ma | 57 watts | 107 db |

FIG. 7
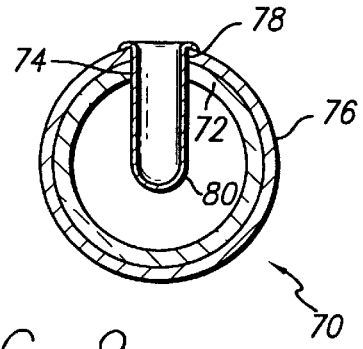
FIG. 8
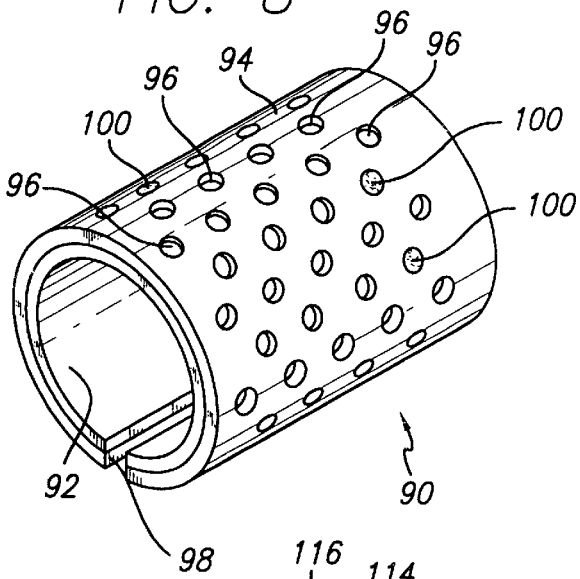
FIG. 9
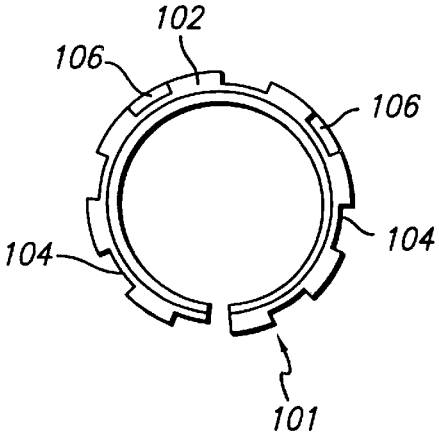
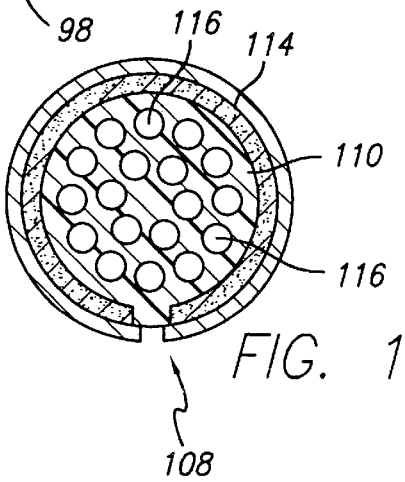
FIG. 10
FIG. 12
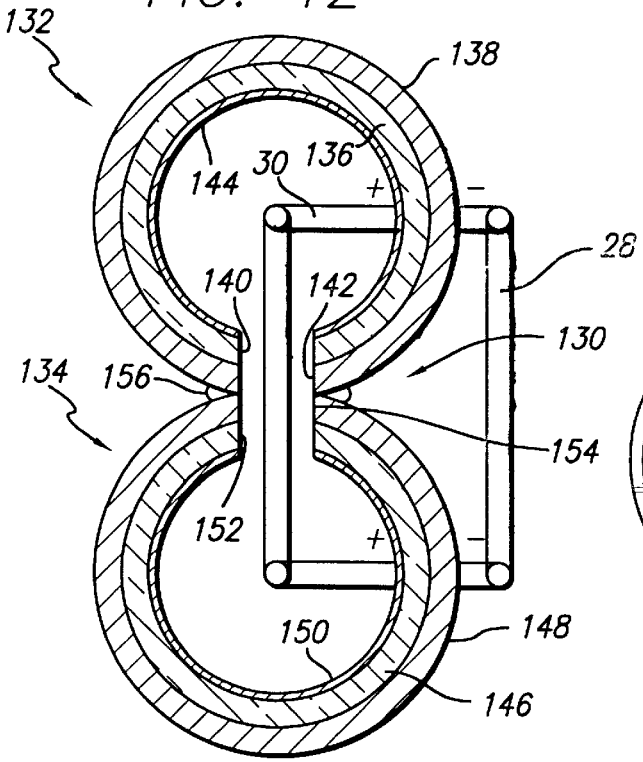
FIG. 11
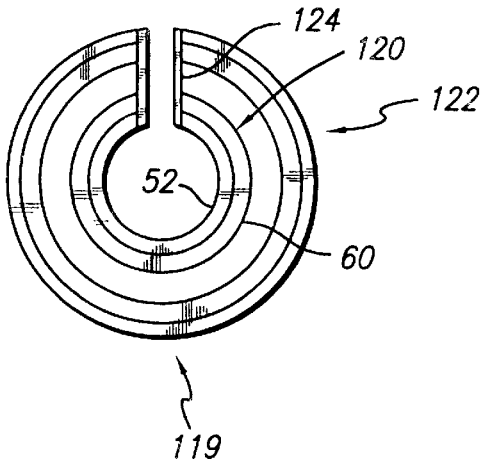

TRANSDUCER RECEIVING VOLTAGE INPUTS, SUCH AS SQUARE WAVES, RICH IN HARMONICS

This invention relates to transducers. More particularly, the invention relates to transducer assemblies which apply increased amounts of power to the earth around the transducer assemblies to obtain an enhanced recovery of oil from the earth.

BACKGROUND OF PREFERRED EMBODIMENTS OF THE INVENTION

As oil wells now in existence are being depleted, it has become increasingly difficult to discover new sources of oil and to recover the oil from these new sources. The oil being discovered is generally at increased depths under the earth's surface. Furthermore, the oil is often viscous and is disposed at positions under the earth's surface where it cannot be easily removed. For these and other reasons, it has become increasingly difficult to recover as much oil from the earth as would otherwise be desired.

Increased forces have had to be applied by the transducers to the earth around the transducers to separate the oil and recover the separated oil from the earth. The problems have been magnified because the characteristics of the earth, even at closely spaced positions, vary. These variable characteristics, even at closely spaced positions, prevent the transducers from operating efficiently to separate and recover the oil from positions below the earth's surface.

BRIEF DESCRIPTION OF PREFERRED EMBODIMENTS OF THE INVENTION

A transducer member is made from a piezeoelectric material (e.g. lead zirconate titanate) having a looped configuration and a gap in the loop and having properties of vibrating upon the introduction of an electrical voltage to the transducer member. A support member made from steel or aluminum and having (a) a looped configuration and enveloping, and attached to, the transducer member has a gap aligned with the transducer member gap and has properties of vibrating with the transducer member.

The transducer member may have a uniform thickness around its periphery or a progressively increasing thickness with progressive distances from the gap. The transducer has a high mechanical Q (e.g. 8–12) and a particular resonant frequency when disposed in air or in a vacuum. When the transducer is disposed below the earth's surface, its resonant frequency may vary because of variations in the earth's characteristics at the different positions.

An alternating voltage having the particular frequency as its fundamental frequency is applied to the transducer member with a particular amplitude. The voltage has harmonics with large amplitudes (as in a square ware) relative to the particular amplitude. When the transducer member is disposed in the earth, sound pressure waves are produced in the transducer with larger amplitudes at harmonics and overtones of the fundamental frequency over a wider frequency range than the magnitude of the amplitude at the fundamental frequency. The harmonics and over tones produce an enhanced recovery of the oil from the earth regardless of the earth's variable characteristics.

BRIEF DESCRIPTION OF THE DRAWINGS

In the drawings:

FIGS. 3 and 3*a* are charts indicating parameters including voltage and current amplitudes and the power into the transducer, and the sound wave pressure output from the transducer at the fundamental frequency and harmonics and overtones of the fundamental frequency, for a sine waveform voltage and for the harmonic-rich voltage shown in FIG. 2 when the peak amplitude of the voltage is 100 volts (FIG. 3*a*) and is 200 volts (FIG. 3*b*);

FIG. 7 is a sectional view of a fifth transducer which is included in the prior art and which is capable of being used with the harmonic-rich alternating voltage shown in FIG. 2 to obtain a preferred embodiment of the invention for providing an enhanced recovery of oil from the earth at a position below the earth's surface;

FIG. 8 is a sectional view of a sixth transducer which is included in the prior art and which is capable of being used with the harmonic-rich alternating voltage shown in FIG. 2 to obtain a preferred embodiment of the invention for providing an enhanced recovery of oil from the earth at a position below the earth's surface;

FIG. 9 is a sectional view of a seventh transducer which is included in the prior art and which is capable of being used with the harmonic-rich alternating voltage shown in FIG. 2 to obtain a preferred embodiment of the invention for providing an enhanced recovery of oil from the earth at a position below the earth's surface;

FIG. 10 is a sectional view of an eighth transducer which is included in the prior art and which is capable of being used with the harmonic-rich alternating voltage shown in FIG. 2 to obtain a preferred embodiment of the invention for providing an enhanced recovery of oil from the earth at a position below the earth's surface.

FIG. 11 is a sectional view of a ninth transducer which is included in the prior art and which is capable of being used with the harmonic-rich alternating voltage shown in FIG. 2 to obtain a preferred embodiment of the invention for providing an enhanced recovery of oil from the earth at a position below the earth's surface;

FIG. 12 is a sectional view of a tenth transducer which is included in the prior art and which is capable of being used with the harmonic-rich alternating voltage shown in FIG. 2 to obtain a preferred embodiment of the invention for providing an enhanced recovery of oil from the earth at a position below the earth's surface.

DETAILED DESCRIPTION OF PREFERRED EMBODIMENTS OF THE INVENTION

Figure 1:
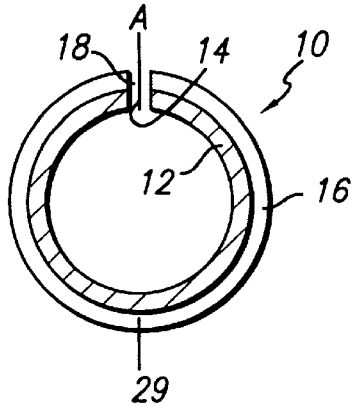
FIG. 1 is a sectional view of a first transducer included in the prior art for recovering oil in the earth from a position below the earth's surface.

FIG. 1 shows a transducer, generally indicated at 10, which constitutes a preferred embodiment in the prior art. The transducer 10 is shown in a number of prior art patents including U.S. Pat. No. 4,774,427 (FIG. 2) issued to Eric D. Plambeck on Sep. 27, 1988 for a Downhole Oil Well Vibrating System and assigned of record to Piezo Sona-Tool Corporation, the assignee of record of this application. The transducer 10 includes a transducer member 12 preferably having a looped (e.g. cylindrical) configuration. The transducer member 12 may be made from a suitable material such as a material having piezoelectric properties. For example, the transducer 10 may be made from a ceramic such as a lead zirconium titanate. An opening or gap 14 is provided in the transducer member 12, preferably in a radial direction.

A support member 16 is provided with a looped (e.g. cylindrical) configuration corresponding to the looped (e.g. cylindrical) configuration of the transducer member 12. The support member 16 is disposed in enveloping relationship to the transducer member 12 and is suitably attached as by a suitable bonding agent to the transducer member 12 along the common surface between the transducer member and the support member. The support member 16 is preferably made from a material which provides support to the transducer member 12 and which vibrates in accordance with the vibrations of the transducer member. Preferably this material may be a steel, aluminum or a graphite epoxy.

Figure 4:
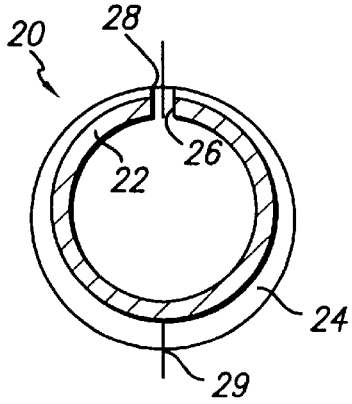
FIG. 4 is a sectional view of a second transducer which is included in the prior art and which is capable of being used with the harmonic-rich voltage shown in FIG. 2 to obtain a preferred embodiment of the invention for providing an enhanced recovery of oil from the earth at a position below the earth's surface.

FIG. 4 illustrates an embodiment of another transducer, generally indicated at 20, included in the prior art. The transducer 20 is shown in FIG. 3 of U.S. Pat. No. 4,774,427. The transducer 20 includes a transducer member 22 and a support member 24. The transducer member 22 and the support member 24 may have substantially the construction specified above for the embodiment shown in FIG. 1. The transducer member 22 and the support member 24 are respectfully provided with openings or gaps 26 and 28. The gaps 26 and 28 may respectively correspond to the gaps 14 and 18 in the embodiment shown in FIG. 1.

The thickness of the support member 24 is progressively increased with progressive distances from the opening or gap 28. The thickness of the support member 24 at each position may be related to the magnitude of the stress experienced by the transducer member 22 at that position. In this way, the maximum thickness of the support member 24 is at a position 29 diametrically opposite the opening or gap 28. By providing progressive increases in the thickness of the support member 24 in this manner, the amplitude of the vibrations in the transducer member 22 may be significantly increased without cracking or otherwise damaging the piezoelectric transducer member 22.

Figure 2:
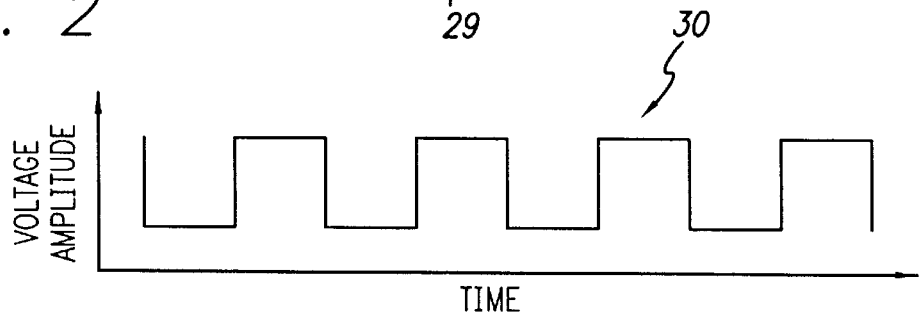
FIG. 2 is a waveform of an alternating voltage (e.g. a square ware voltage) included, with the transducer shown in FIG. 1, in a preferred embodiment of the invention and applied to the transducer to obtain an optimal recovery of oil from the earth, the alternating voltage including a fundamental frequency and being rich in harmonics.

FIG. 2 illustrates a voltage waveform, generally indicated at 30, which may be applied to the transducer member 12 in FIG. 1 or to the transducer member 22 in FIG. 4. The voltage waveform 30 has a fundamental frequency which corresponds to the frequency at which the transducer 10 in FIG. 1 or the transducer 20 in FIG. 2 vibrates when the transducer is disposed in air and alternating voltage is applied to the transducer member in the transducer. For reasons which will be described in detail subsequently, the voltage waveform 30 is rich in harmonics. For example, the voltage waveform 30 may constitute a square wave.

Applicant has made a series of tests, using different voltage waveforms, to evaluate the operation of applicant's transducers such as the transducers shown in FIGS. 1 and 4. Applicant utilized alternating voltages having sine waveforms, triangular waveforms and square waveforms (such as shown in FIG. 2) in these tests. In these tests, the sine waveform, the triangular waveform and the square waveform had substantially the same peak amplitude. To applicant's surprise, the alternating voltage having a square waveform generated increases in power output from the transducers that were orders of magnitude greater than the power output, obtained from the sine and triangular waveforms. For example, this increase in power output was as much as ten (10) times or fifteen (15) times greater than the power output generated by voltages with the sine and triangular waveforms.

The increase in the power output of the transducers 10 and 20 is dependent upon how far the transducer is operating in the earth from the resonant frequency of the transducer (when disposed in air). The power increase of the transducer is extended over a wide frequency range of harmonics and overtones compared to the power generated in the earth by the transducer at the fundamental resonant frequency of the transducer (this fundamental resonant frequency being determined when the transducer is operated in air). The increase in power output over the significant range of harmonics and overtones significantly increased the apparent bandwidth when the transducer operated in the earth as the impedance provided by the earth varied at different positions in the earth.

The transducers tested had either a two inch (2") diameter or a four inch (4") diameter. They had a relatively high mechanical Q. For example, the transducers had a mechanical Q in the range of fourteen (14) to eighteen (18). The tools were internally pressurized to one hundred pounds per square inch (100 psi) and were hung inside a plastic test tank with a twelve inch (12") outer diameter. A sound meter was placed on the outside of the tank with the microphone tangent to the surface of the test tank. Since applicant had no way of measuring absolute values in water and no way of correcting for reflection and standing waves over the frequency range of the harmonics and overtones of the fundamental frequency, the most reliable and repeatable method of testing for sine waveform voltage testing and square waveform voltage testing appeared to be the method of testing with a sound meter.

As will be seen from the chart shown in FIG. 3*a*, when a voltage with a square waveform was applied to the transducer, the high mechanical Q of the transducer produced many powerful harmonics and overtones that were either non-existent or greatly attenuated when the transducer was powered with an alternating voltage with a sine waveform. This may be seen from the different columns in the chart shown in FIG. 3*a*. The first column in FIG. 3*a* indicates the characteristics of the voltage waveform and indicates "sine" (sine wave) for first alternate rows and "square" (square wave) for the other alternate rows. The second column in FIG. 3 indicates the frequency (in hertz) of one of the components in the waveform. As will be seen, the fundamental frequency is 200 hertz.

The third ($3^{rd}$) column in FIG. 3*a* indicates the peak amplitude value of the input voltage to the transducer. As will be seen, the current in the transducer member is considerably greater at the fundamental frequency, the harmonics and the overtones for the square wave voltage than for the sine wave voltage. Furthermore, the current at the fundamental frequency of 200 hertz for the square wave voltage exceeded the current at the fundamental frequency for the sine wave voltage. The current at the harmonic and overtone frequencies for the square wave voltage in many cases exceeded the current at the same harmonic and overtone frequencies for the sine wave voltage. The fourth ($4^{th}$) column in FIG. 3*a* indicates the current in the transducer in milliamperes.

The fifth ($5^{th}$) column in FIG. 3*a* is designated as "power in". It indicates the power input to the transducer. It will be noted that the power input to the transducer is considerably greater at the fundamental frequency, the harmonics and the overtones for the square waveform than for the sine waveform. The sixth ($6^{th}$) column in FIG. 3*a* indicates the power output from the transducer, as measured by the sound pressure of the output waves. As will be seen the power output is much greater at the fundamental frequency, the harmonics and the overtones for the square wave voltage than for the sine wave voltage. This is through a range of frequencies between the fundamental frequency of 200 hertz and an overtone of 950 hertz. This is consistently true of every frequency between the range of 200–950 hertz.

FIG. 3*b* is a chart similar to that shown in FIG. 3*a* but involves a peak voltage of 200 volts for the sine wave voltage and the square wave voltage. The six (6) columns in FIG. 3*b* have the same headings as the headings for the corresponding columns shown in FIG. 3*a*. The chart shown in FIG. 3*b* extends only between 600 hertz and 900 hertz. The reason is that no signal could be obtained for the sine wave voltage between 200 hertz and 550 hertz. In this frequency range, the sound meter had a reading of 73 db, which corresponded to the ambient noise level in the test facility. However, the square wave over the frequency range of 200–550 hertz did respond significantly over this frequency range as indicated by sound pressure readings of 97 db to 101 db for the different frequencies. Furthermore, significant increases in power output occurred for the square wave voltage in the harmonics and overtones over the frequency range of 600 hertz to 900 hertz in comparison to the power output for the sine wave voltage over this range of frequencies.

The reasons for the differences in the output from the transducer at the harmonics and overtones between the application of a square wave voltage and a sine wave voltage to the transducer, through an extended frequency range of 200 hertz to 950 hertz, are not known. However, the differences in the power output at the harmonics and overtones through an extended frequency range such as 200–950 hertz are surprising and unexpected. This is particularly surprising and unexpected in view of the large range of frequencies through which the large power outputs are obtained. Such differences may result from changes in the characteristics of the earth at different positions below the earth's surface. The differences are even more surprising and unexpected at overtones of the fundamental frequency than at harmonics of the fundamental frequency. As will be seen, the power output at the overtone frequencies for the square wave voltage often exceeded the power output at the harmonic frequencies for the square wave voltage and considerably exceeded the power output at the fundamental frequency.

Figure 5:
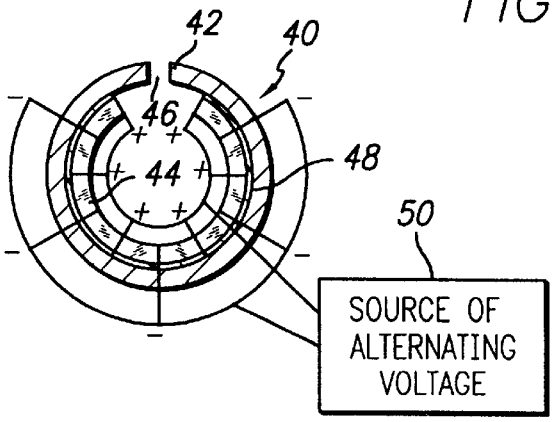
FIG. 5 is a sectional view of a third transducer which is included in the prior art and which is capable of being used with the harmonic-rich voltage shown in FIG. 2 to obtain a preferred embodiment of the invention for providing an enhanced recovery of oil from the earth at a position below the earth's surface.

FIG. 5 is an enlarged sectional of another preferred embodiment, generally indicated at 40, of a prior art transducer to which a harmonic-rich alternating voltage such as illustrated at 30 in FIG. 3 is applied to obtain a preferred embodiment of this invention. The transducer 40 is shown in FIG. 1 of U.S. Pat. No. 4,651,044 which issued to applicant on Mar. 17, 1987, for an "Electricoustical Transducer".

The transducer 40 in FIG. 5 includes a support member 42 corresponding to the support member 16 in FIG. 1 or corresponding to that shown in any of the other Figures of this application. A plurality of sectionalized transducer elements 44 are arranged within the support member 42 in abutting and progressive relationship to one another and in abutting relationship to the inner wall of the support member. The sectionalized elements 44 are preferably provided with equal circumferential lengths and thicknesses and are disposed in symmetrical relationship to the support member 42, and particularly in symmetrical relationship to an opening or gap 46 in the support member. The opening or gap 46 corresponds to the opening or gap 18 in the support member 16 in FIG. 1.

The sectionalized transducer elements 44 may be made from a suitable ceramic material having piezoelectric properties. The sectionalized transducer elements 44 are bonded to the inner wall of the support member 42 by any suitable adhesive 48. The adhesive 48 has properties of insulating the sectionalized elements 44 from the support member 42. The sectionalized transducer elements 44 are polarized circumferentially rather than through the wall thickness.

Circumferential polarization of the sectionalized transducer elements 44 provides the transducer 40 with a relatively high coupling co-efficient such as a coefficient of at least fifty percent (50%). This high coupling coefficient facilitates the production of a good bond between the sectionalized transducer elements 44 and enhances efficiency in the conversion of electrical energy to acoustical energy. Alternating voltages are introduced to the sectionalized elements 44 from a source 50. The introduction of such signals to the elements 44 in the plurality may be provided on a series basis or a parallel basis. The alternating voltages from the source 50 are preferably harmonic-rich as indicated at 30 in FIG. 2.

When harmonic-rich alternating voltages are introduced from the source 50 to the sectionalized elements 44, the voltages produce vibrations of the sectionalized elements 44.

These vibrations in turn produce vibrations in the support member 42, which functions in the manner of a tuning fork. The frequency of these vibrations is dependent somewhat upon the characteristics, such as the thickness and diameter, of the support member 42. As a result, for a support member 42 of a particular diameter, the resonant frequency of the transducer 40 may be primarily controlled by adjusting the thickness of the support member 42. This resonant frequency constitutes the fundamental frequency of the alternating voltage from the source 50.

The embodiment shown in FIG. 5 has certain important advantages. It provides a conversion of electrical energy to acoustical energy at low frequencies such as frequencies in the order of two kilohertz (2 kHz) or less. The fundamental frequency of the acoustical energy can be precisely controlled. Furthermore, the transducer 40 provides a relatively large amount of energy since the support member 42 can be provided with sturdy characteristics by the selection of a particular metal such as steel and by the provision of an adequate thickness for the support member. In addition, the use of the sectionalized transducer elements 44 inhibits any cracking of the support member 42 by the sectionalized transducer elements 44 even when the elements are subjected to a considerable amount of electrical energy.

The formation of the transducer 40 from the support member 42 and the sectionalized elements 44 is further advantageous since the efficiency in the transfer of energy from electrical energy to mechanical movement is materially enhanced over that obtained in the prior art. For example, the embodiment of FIG. 5 obtains an efficiency of well in excess of fifty percent (50%) in the conversion of electrical energy to mechanical movement. This is in contrast to efficiencies of approximately thirty-one percent (31%) from similar conversions in the prior art.

Figure 6:
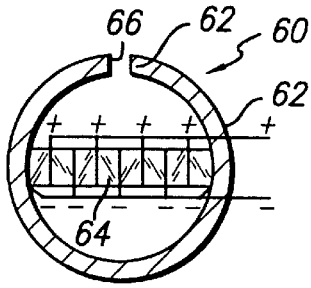
FIG. 6 is a sectional view of a fourth transducer which is included in the prior art and which is capable of being used with the harmonic-rich alternating voltage shown in FIG. 2 to obtain a preferred embodiment of the invention for providing an enhanced recovery of oil from the earth at a position below the earth's surface.

FIG. 6 illustrates another preferred embodiment of a transducer, generally indicated at 60, of the prior art. The transducer 60 in FIG. 6 corresponds to the transducer shown in FIG. 2 of U.S. Pat. No. 4,651,044. This transducer constitutes a preferred embodiment of the invention when it is energized by the harmonic-rich voltage waveform shown at 30 in FIG. 2. The embodiment shown in FIG. 6 is not as advantageous as the embodiment shown in FIG. 5 since it does not produce as much mechanical energy from a given amount of electrical energy as the embodiment shown in FIG. 5. However, the embodiment shown in FIG. 6 is less expensive to manufacture than the embodiment shown in FIG. 5 since it is easier to stack the sectionalized elements radially in FIG. 6 than to stack the sectionalized transducer elements circumferentially as shown in FIG. 5.

The embodiment shown in FIG. 6 includes a support member 62 corresponding to that shown in FIG. 5 and further includes sectionalized transducer elements 64. In the embodiment shown in FIG. 6, the sectionalized transducer elements 64 are linearly stacked in abutting relationship to one another and the sectionalized transducer elements at the ends of the stack are attached to the inner wall of the support member 62 at diametrical positions equally spaced from an opening or gap 66 in the support member 64. Thus, when alternating voltages are introduced to the sectionalized transducer elements 64, the elements vibrate and produce vibrations in the support member 62. The vibrations of the support member 62 at positions adjacent to the opening or gap 66 in FIG. 6 are similar to the vibrations of the support member 42 adjacent to the opening or gap 46 in FIG. 5.

A prior embodiment of another preferred transducer of the prior art is generally indicated at 70 in FIG. 7. The transducer 70 is shown in FIG. 1 of U.S. Pat. No. 5,122,992 issued to applicant on Jun. 16, 1992, for a Transducer Assembly and assigned of record to the assignee of record of this application. The transducer 70 constitutes a preferred embodiment of the invention when it is energized by a harmonic rich voltage waveform such as shown at 30 in FIG. 2. The transducer member 70 includes a transducer member 72 having an opening or gap 74 and a support member 76 having an opening or gap 78. The transducer member 72 and the support member 76 may respectively correspond to the transducer member 12 and the support member 16 in FIG. 1.

A closure member 80 may be suitably attached, as by welding, to the support member 76 at the opposite ends of the gap 78. The closure member 80 may be disposed (in section) in a U-shaped configuration which extends into the space within the looped configurations defined by the transducer member 72 and the support member 76. The closure member 80 may be made from a suitable material having spring-like properties so that the transducer member 72 and the support member 76 will be able to vibrate when the transducer member receives electrical energy. For example, the closure member 80 may be made from a 413 alloy steel tempered to withstand approximately 130 psi to approximately 140 psi. The opposite axial ends of the transducer 70 may be closed by end caps as indicated in FIG. 2 of U.S. Pat. No. 5,122,992. The distance of the extension of the closure member 80 into the space within the looped configuration of the transducer member 72 may be varied as shown in the drawings in U.S. Pat. No. 5,122,992.

FIG. 8 is an enlarged sectional view of another transducer, generally indicated at 90, constituting another preferred prior art embodiment. The transducer 90 is shown in FIG. 2 of U.S. Pat. No. 5,020,035 issued to applicant on May 28, 1991, for "Transducer Assemblies". The transducer 90 constitutes a preferred embodiment of the invention when it is energized by the harmonic-rich waveform voltage shown in FIG. 2.

The transducer 90 includes a transducer member 92 and a support member 94 respectively corresponding to the transducer member 12 and the support member 16 shown in FIG. 1. Sockets 96 are provided in the outer periphery of the support member 94. The sockets 96 preferably extend only partially through the thickness of the support member 94. In this way, the sockets 96 tend to make the support member 94 thinner at the positions of the sockets. The sockets 96 are shown in FIG. 8 as being disposed at spaced positions on the complete periphery of the support member 94. However, the sockets 96 can be disposed only at positions adjacent an opening or gap 98 in the support member or at any other portion of the peripheral surface of the support member. The sockets 96 may be filled or partially filled with a suitable material 100. Preferably the material 100 is compliant and has a weight per unit of area less than that of the material of the support member 94. For example, the material 100 may be a urethane or polyurethane. As will be appreciated, some, but not necessarily all, of the sockets 96 may be filled with the material 100.

The sockets 96 provide certain advantages when included on the periphery of the support member 94. They decrease the weight of the transducer 90. They also tend to control the fundamental frequency at which the transducer 90 resonates. As will be appreciated, the number of the sockets 96 in the support members 94 and the disposition of the sockets in the support member will affect the fundamental frequency at which the transducer 90 resonates. The inclusion of the material 100 in the sockets 96 also affects the fundamental frequency at which the transducer 90 resonates.

The embodiment generally indicated at 101 in FIG. 9 is shown in FIGS. 3 and 4 of U.S. Pat. No. 5,020,035. It is similar in a number of respects to the embodiment shown in FIG. 8. However, instead of providing the sockets 96 in the support member 92 as in FIG. 8, a support member 102 is provided with grooves 104 extending axially along the length of the support member. The grooves 104 may be filled with a suitable material 106 such as urethane or polyurethane. The grooves 104 and the material 106 provide the same advantages as described above for the embodiment shown in FIG. 8. This is even true with respect to the control of frequency in the transducer 101 since the relative disposition of the grooves 102 controls the vibrational frequency of the transducer in a manner similar to that described above for the embodiment shown in FIG. 8.

The embodiment generally indicated at 108 in FIG. 10 corresponds to the embodiment shown in FIGS. 5 and 6 of U.S. Pat. No. 5,020,035. The embodiment 108 in FIG. 10 includes a compliant material 110 such a urethane or a polyurethane within the hollow interior of a transducer member 114. The compliant material 110 may be suitably bonded to the interior surface of the transducer member 114 included in the transducer 108. Air chambers or cavities 116 may be provided in the material 110 at spaced positions. The air chambers or cavities 116 extend axially through the compliant material 110. End caps made from a suitable material such as a urethane may plug the end of the hollow interior of the transducer 112.

FIG. 11 illustrates an embodiment which is shown in FIGS. 9 and 10 of U.S. Pat. No. 5,020,035 and which is generally indicated at 119. The embodiment 119 includes a pair of transducers, generally indicated at 120 and 122, each of which may have a construction corresponding to the construction shown in FIG. 1 of this application or corresponding to that shown in any of the Figures of this application. As will be seen, the transducer 120 has a smaller size than the transducer 122 so that it can be disposed within the transducer 122 in a substantially concentric relationship with the transducer 122. Bracing members such as a member 124 extend between the openings or gaps in the transducers 120 and 122 to hold the transducers in a fixed relationship with each other. The bracing members 124 are attached at opposite ends to the support members in each of the transducers 120 and 122.

Preferably the transducers 120 and 122 vibrate at substantially the same fundamental frequency. This can be accomplished by carefully selecting the parameters of the support members in the transducers 120 and 122. Since the transducer 120 and 122 vibrate at substantially the same frequency, the vibrations from one reinforce the vibrations from the other. As a result, the amplitudes of the vibrations from the transducers 120 and 122 are significantly enhanced.

It will be appreciated that the transducer member can be removed from the transducer 120 so that only the support member is provided. This is shown in FIG. 7 of U.S. Pat. No. 5,020,035 and is incorporated in this application by reference to the '035 patent. This support member reinforces the support member in the transducer 122, particularly in view of the bracing action provided by the members 124. This prevents the transducer 122 from cracking at the weak points. Because of this, the amplitudes of the vibrations in the transducer assembly 122 can be significantly increased without damaging the transducer.

FIG. 12 is an enlarged sectional view of a preferred embodiment, generally indicated at 130, of a prior art transducer assembly. This transducer is shown in FIGS. 1 and 2 of U.S. Pat. No. 5,592,359 issued on Jan. 7, 1997, for a "Transducer" to the applicant of this application. When the transducer 130 receives a harmonic-rich voltage waveform such as shown at 30 in FIG. 2 of this application, the combination constitutes a preferred embodiment of the invention.

The transducer assembly 130 includes a pair of transducers respectively indicated generally at 132 and 134. Each of the transducers may have a construction corresponding to that shown in FIG. 1 of this application or in any of the other Figures of this application. Thus, the transducer 132 may include a transducer member 136 and a support member 138 and may further include openings or gaps 140 and 142 respectively in the transducer member and the support member. An electrically conductive coating 144 may be provided on the inner surface of the transducer member 136 so that the coating of the transducer member and the support member 138 define a capacitor.

In like manner, the transducer 134 may include a transducer member 146, a support member 148, a coating 150 on the inner surface of the transducer member and openings or gaps 152 and 154 respectively in the transducer member and the support member. The support members 138 and 148 are bonded to each other as at 156 at the positions where they abut each other. In the abutting relationship, the openings or gaps 140 and 142 in the transducer 132 abut and are aligned with the gaps 152 and 154 in the transducer 134. An alternating voltage rich in harmonics, such as shown at 30 in FIG. 2, is applied between the support member 138 and the coating 144 and between the support member member 148 and the coating 150. Preferably the voltages applied to the transducers 132 and 134 are in phase.

The transducers 132 and 134 are effectively connected electrically in parallel and in a synchronous relationship with each other. This causes the capacitances defined in the transducers 132 and 134 to be in parallel with each other. This causes the electrical current in the transducers 132 and 134 to be doubled in comparison to the electrical current in each of the transducers as a separate unit. The effective doubling of the current in the transducer assembly 130 increases the amplitude of the vibrations in the transducer assembly. This enhances the effectiveness of the transducer assembly 130 in separating the fluid such as oil from the earth in which the oil is located and in recovering the oil.

In measurements made by applicant on the transducer assembly 130, applicant has found that the transducer assembly 130 is as much as four (4) times as effective as the transducer 132 or the transducer 134 when the transducers operate separately. As will be appreciated, this is approximately twice as great as the increase in the value of the capacitances in the transducers 132 and 134 as a result of the connection of these capacitances in parallel. This increase in effectiveness does not consider the increase in the effectiveness of the transducer assembly 130 as a result of the use of the harmonic-rich voltage 30 such as shown in FIG. 2.

The transducer assembly 130 also has other advantages over the prior art. This results from the fact that the lower half of the transducer assembly 130 tends to produce forces in a downward direction and that the upper half of the transducer assembly tends to produce vibratory forces in an upward direction. These vibratory forces tend to cancel each other. This is particularly true since the downward vibratory forces produced by the lower half of the transducer assembly 130 and the upward vibratory forces produced by the upper half of the transducer assembly are somewhat limited by the action of the bond 156.

As will be appreciated, vibratory forces are primarily desired in the horizontal direction in FIG. 12 outwardly from the transducers 132 and 134. Since the vertical components of the vibratory forces in the transducers 132 and 134 tend to be canceled by the coupling of the transducer by the bond 156, the result in the transducer assembly 130 is that the vibratory energy in the transducer assembly 130 is primarily outwardly in the horizontal direction. This may explain, at least in part, why the transducer assembly 130 is as much as four (4) times more effective than when the transducer 132 or the transducer 134 is operated separately.

Figure 13:
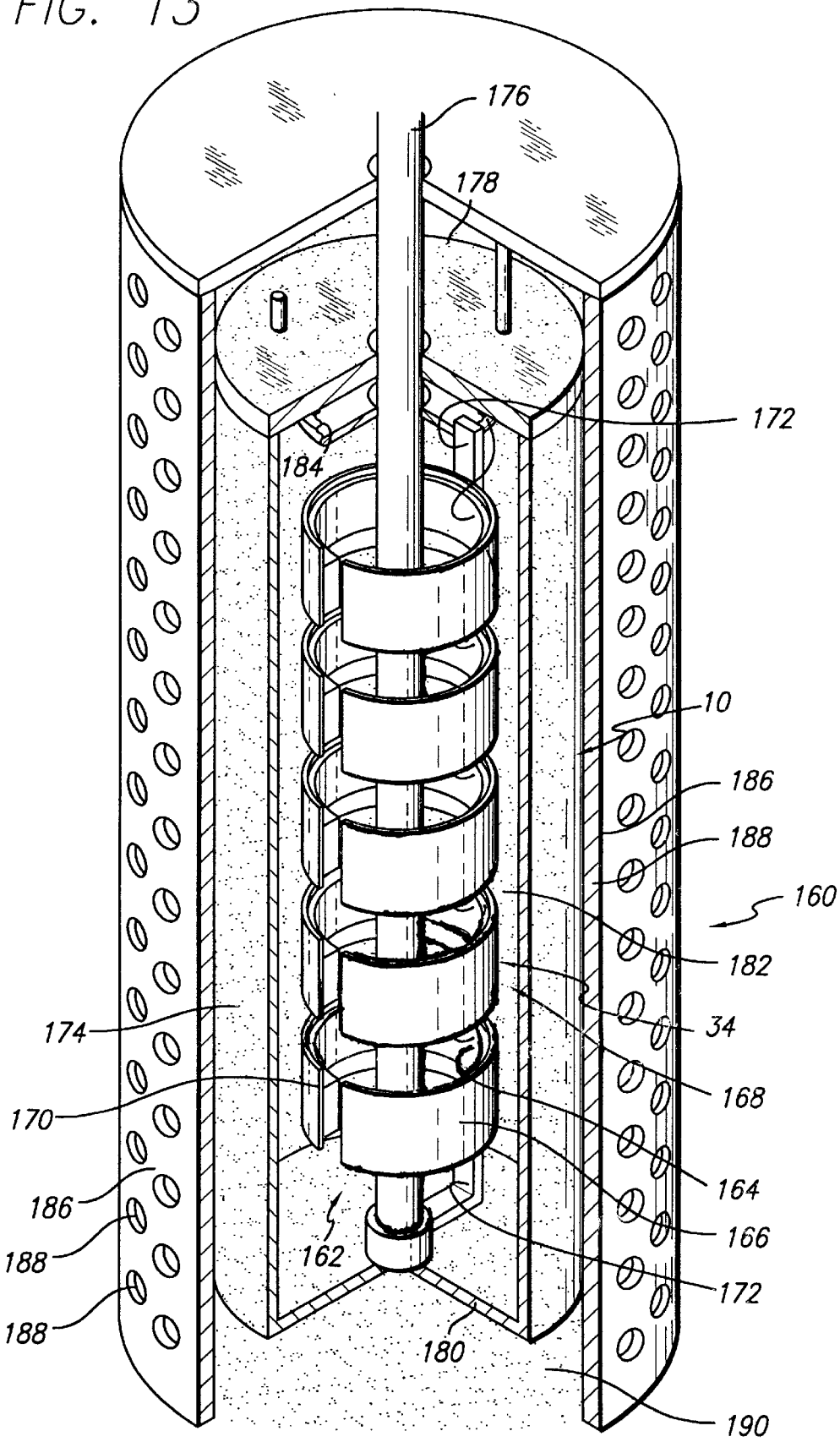
FIG. 13 is a sectional view of an eleventh transducer which is included in the prior art and which is capable of being used with the harmonic-rich alternating voltage shown in FIG. 2 to obtain a preferred embodiment of the invention for providing an enhanced recovery of oil from the earth at a position below the earth's surface.

FIG. 13 is a perspective view of a preferred embodiment of a transducer assembly, generally indicated at 160, of the prior art. The transducer assembly shown in FIG. 13 corresponds to the transducer assembly shown FIGS. 1 and 2 of U.S. Pat. No. 4,658,897 issued jointly to applicant and other inventors on Apr. 21, 1987, for "Downhole Transducer Systems" and assigned of record to the assignee of record of this application. The transducer assembly 160 is a preferred embodiment of this invention when a harmonic-rich voltage such as indicated at 30 in FIG. 2 is applied to the transducers in the transducer assembly.

The transducer assembly 160 includes one or a plurality of transducers. When a plurality of transducers are provided, each may have a construction which is shown is FIG. 1 or any other of the Figures in this application. For example, a transducer generally indicated at 162 may include a transducer member 164 and a support member 166 such as shown in FIG. 1. The opening or gap in each transducer does not have to be aligned with the opening or gap in any of the other transducers. For purposes of simplification, only the transducer 162 and a transducer generally indicated at 168 are shown in FIG. 13.

The support member 166 may be clamped at a position which is preferably diametrically opposite a slot 170 in the support member. The clamping may be provided by a mounting rod 172 which is suitably attached to a tubing or sleeve 174. The tubing 174 may be disposed in a concentric relationship with the transducer members 164 and 168 and may be spaced from the support member. The tubing 174 is preferably made from a suitable metal such as aluminum or stainless steel.

A support rod 176 extends axially through the tubing 174 and the transducer members in the transducers 162 and 168. The rod 176 may be dependent from the bottom of a pump (not shown). End plates 178 are disposed at the opposite end of the tubing 174 and are coupled to the mounting rod 172 and the rod 176 to provide a support of the tubing 174. The tubing 174 is preferably filled with an oil 182 such as a silicon oil. The oil may be provided with characteristics to lubricate the different parts and to communicate vibrations from the transducers 162 and 168 to the tubing 174.

A bellows 184 is preferably disposed adjacent the upper end plate 178. The bellows 184 expands or contracts with changes in temperature to provide a compensation within the tube 174 for changes in the space occupied by the oil 182 in accordance with such changes in temperature and pressure. A casing 186 envelopes the tubing 172. The casing 186 may be perforated as indicated at 188 to provide for the passage of oil 190 from a position outside of the casing 186 through the perforations into the space between the tubing 174 and the casing 186. The oil 190 in the casing 186 accordingly functions to transmit to the casing the vibrations produced in the transducers such as the transducers 162 and 168.

When electrical energy is applied to the transducers such as the transducers 162 and 168, the transducers produce vibrations. These vibrations are transmitted to the tubing 174 to produce vibrations of the tubing in the "hoop" or radial mode and arc then transmitted to the casing 186 through the oil 190 in the casing. The casing 186 accordingly vibrates in the "hoop" or radial mode. This produces a flow of the oil 190 into the casing 186 from the earth surrounding the casing.

Although this invention has been disclosed and illustrated with reference to particular preferred embodiments, the principles involved are susceptible for use in numerous other embodiments which will be apparent to persons of ordinary skill in the art. The invention is, therefore, to be limited only as indicated by the scope of the appended claims.

What is claimed is:

1. A method of recovering oil from the earth at positions below the surface of the earth, including the steps of:

providing a transducer resonant at a frequency in one of the sonic and sub-sonic ranges and formed from (a) a transducer member having a looped configuration and having a gap at a position in the looped configuration and having properties of vibrating in accordance with the introduction of an electrical voltage to the transducer member and (b) a support member attached to the transducer and having a looped configuration enveloping the transducer member and having properties of vibrating with the transducer member, and applying an alternating voltage to the transducer with a fundamental frequency corresponding substantially to the resonant frequency of the transducer and with square wave characteristics to produce vibrations of the transducer and the recovery of oil as a result of the vibrations when the transducer is disposed in the earth.

2. A method as set forth in claim 1 wherein the transducer has a resonant frequency of approximately 200 hertz.

3. A method as set forth in claim 1 wherein the earth has at different positions characteristics affecting the frequency at which the transducer resonates and wherein the square wave characteristics of the alternating voltage produce harmonics and overtones of the fundamental frequency with amplitudes providing for a recovery of the oil from the earth.

4. A method as set forth in claim 1 wherein the transducer member is made from a dielectric material having properties of vibrating when subjected to an alternating voltage and wherein the support member is made from a material having properties of supporting the transducer member when the transducer member is vibrating.

5. A method as set forth in claim 2 wherein the transducer is disposed in the earth and the square wave voltage is applied to the transducer with the transducer disposed in the earth to produce vibrations of the transducer at the harmonics and overtones of the fundamental frequency for recovering the oil from the earth.

6. A method as set forth in claim 1 wherein the transducer has a high mechanical Q at the fundamental frequency and wherein the transducer produces higher magnitudes of sound pressure waves at harmonics and overtones than at the fundamental frequency when the voltage is applied at the fundamental frequency to the transducer with the transducer in the earth.

7. A method as set forth in claim 2 wherein sockets are provided at spaced positions in the support member.

8. A method as set forth in claim 2 wherein the support member is provided with axially extending grooves at annularly spaced positions on the external surface of the support member.

9. A method as set forth in claim 8 wherein a compliant material is disposed in at least some of the grooves in the support member.

10. A method as set forth in claim 1 wherein the support member is provided with grooves at spaced positions.

11. A method as set forth in claim 1 wherein a closure member is disposed in the gaps in the transducer member and the support member and is attached to the support member and is extended into the space within the looped configuration of the transducer member.

12. A method as set forth in claim 11 wherein the closure member is provided with a U-shaped configuration having an opening substantially at the position of the gaps and wherein the closure member is extended in a substantially radial direction into the space between the gaps in the transducer member and the support member at one end and the positions on the transducer member and the support member radially opposite to the gaps at the other end.

13. A method as set forth in claim 1 wherein the transducer constitutes a first transducer and the transducer member constitutes a first transducer member and the support member constitutes a first support member and wherein a second transducer includes a second transducer member and a second support member of substantially the same construction as, but of a different size than, the first transducer and wherein the first and second transducers have a concentric relationship with the gaps in the first and second transducers having a substantially aligned radial relationship and wherein bracing members extend between the gaps in the first and second transducers to retain the transducers in the concentric relationship.

14. A method as set forth in claim 1 wherein the support member has an inner wall and wherein the transducer member is formed from a plurality of sectionalized transducer elements in abutting relationship to one another and in abutting relationship to the inner wall of the support member.

15. A method as set forth in claim 14 wherein the sectionalized transducer elements of the transducer member are circumferentially polarized.

16. A method as set forth in claim 14 wherein the sectionalized transducer elements are disposed in a radial direction between opposite ends of the support member at positions equally displaced from the gap in the support member at the opposite ends of the sectionalized transducer elements.

17. A method as set forth in claim 14 wherein the sectionalized transducer elements are disposed in a radial direction within the loop defined by the support member and are attached at their opposite ends to the support member and are equally spaced at their opposite ends from the gap in the support member.

18. A method as set forth in claim 1 wherein the transducer constitutes a first transducer and the support member constitutes a first support member and wherein a second transducer has a second transducer member and a second support member respectively corresponding to the first transducer member and the first support member and wherein the first and second transducers have a substantially common plane and have an attachment of the first and second support members to maintain the first and second transducers in the substantially common plane.

19. A method as set forth in claim 18 wherein the second transducer member and the second support member have gaps respectively corresponding to the gaps in the first transducer member and the first support member and wherein the transducers are disposed in the common plane with the gaps in the transducers in an adjacent and aligned relationship and wherein the support members in the first and second transducers, are attached to each other at the positions where the gaps in the first and second transducers are adjacent to each other.

20. A method as set forth in claim 1 wherein the transducer constitutes a first transducer and wherein at least one additional transducer is provided with characteristics corresponding to those of the first transducer and wherein the first transducer and the additional transistor are provided with planar characteristics and wherein the first transducer and the additional transducer are disposed with their planar characteristics in a spaced and substantially parallel relationship and wherein means are provided for maintaining the first transducer and the additional transducer with the planar characteristics in the spaced and substantially parallel relationship.

21. A method as set forth in claim 20 wherein the first transducer and the additional transducer are fixedly disposed in a tubing and wherein the tubing is filled with fluid.

22. A method as set forth in claim 21 wherein the tubing is disposed in a casing and wherein the casing is perforated to provide for a passage of oil from the earth around the casing into the space between the casing and the tubing.

23. A method of extracting oil from areas below the surface of the earth, including the steps of:

providing a substantially cylindrical hollow transducer resonant at a fundamental frequency in one of the sonic and sub-sonic ranges and having an inner transducer member made from a material having properties of vibrating upon an application of a voltage to the transducer member and having an outer support member disposed on the transducer member and attached to the transducer member and having properties of vibrating, the inner transducer member and the outer support member being provided with gaps at corresponding positions, and applying to the transducer member an alternating voltage having substantially the fundamental frequency with a particular amplitude and having harmonics and overtones with large amplitudes relative to the particular amplitude of the alternating voltage at the fundamental frequency.

24. A method as set forth in claim 22 wherein the transducer is resonant at the fundamental frequency with the transducer disposed in air and has a high mechanical Q at the fundamental frequency.

25. A method as set forth in claim 24 wherein the transducer is resonant at a frequency of approximately 200 hertz and the fundamental frequency of the voltage source is approximately 200 hertz.

26. A method as set forth in claim 23 wherein the transducer is resonant at the fundamental frequency when it is not disposed in the earth and wherein the transducer has a high mechanical Q at the fundamental frequency and wherein the transducer develops harmonics and overtones of the fundamental frequency when the transducer is disposed in the earth and wherein some of the harmonics and overtones develop more output power than the output power developed at the fundamental frequency when the transducer is disposed in the earth.

27. A method as set forth in claim 23 wherein the transducer member is made from a piezoelectric material and the support member is made from a material providing a support for the transducer member and having properties of vibrating with the transducer member.

28. A method as set forth in claim 27 wherein the transducer member is provided with a substantially uniform thickness throughout its annular periphery and the support member is provided with a substantially uniform thickness throughout its annular periphery.

29. A method as set forth in claim 28 wherein the transducer is disposed in earth having oil distributed through the earth and wherein the alternating voltage at the fundamental frequency and the harmonics and overtones is applied to the transducer with the transducer in the earth and wherein the earth around the transducer affects the characteristics of the transducer such that sound pressure waves are produced by the transducer at harmonics and overtones of the fundamental frequency over an extended frequency range and wherein the magnitudes of the sound pressure waves at the harmonics and the overtones over the extended frequency range are greater than the magnitudes of the sound pressure waves at the fundamental frequency, thereby providing for the recovery of the oil from the earth regardless of the characteristics of the earth.

30. A method as set forth in claim 28 wherein the transducer is disposed in earth having oil distributed through the earth and wherein the alternating voltage at the fundamental frequency and the harmonics and overtones is applied to the transducer with the transducer in the earth and wherein the earth around the transducer affects the characteristics of the transducer such that sound pressure waves are produced by the transducer at harmonics and overtones of the fundamental frequency over an extended frequency range and wherein the magnitudes of some of the sound pressure waves at the harmonics and the overtones over the extended frequency range are greater than the magnitudes of the sound pressure waves at the fundamental frequency, thereby providing for the recovery of the oil from the earth regardless of the characteristics of the earth.

31. A method as set forth in claim 27 wherein the transducer member is made from a piezoelectric material and the support member is made from a material providing a support for the transducer member and having properties of vibrating with the transducer member.

32. A method as set forth in claim 23 wherein the support member is provided with a progressively increasing thickness at progressive distances in opposite directions from the gap.

33. A method as set forth in claim 23 wherein the transducer is disposed in earth having oil distributed through the earth and wherein the alternating voltage at the fundamental frequency is applied to the transducer with the transducer disposed in the earth and wherein sound pressure waves with higher amplitudes are produced in the transducer at harmonics and overtones of the fundamental frequency than the amplitude of the sound pressure waves produced at the fundamental frequency, thereby to obtain a recovery of the oil from the earth.

34. A method as set forth in claim 23 wherein the transducer member is formed from a plurality of sectionalized transducer elements attached to the circumferential inner surface of the support member.

35. A method as set forth in claim 23 wherein the transducer member is formed from a plurality of radially disposed sectionalized transducer elements and wherein the sectionalized transducer elements disposed in the plurality at the outer radial ends of the transducer member are attached to the support member at positions equally spaced from the gap in the support member.

36. A method as set forth in claim 23 wherein the transducer member has a cylindrical configuration and wherein a closure member made from a resilient material is provided with an opening at one end and is closed at the other end and wherein the closure member is attached at the open end to the support member at the position of the gap in the support member and wherein the closure member is disposed at its closed end in the space within the cylindrical configuration of the transducer member.

37. A method as set forth in claim 23 wherein sockets are disposed in the support member.

38. A method as set forth in claim 37 wherein at least some of the sockets are at least partially filled with a compliant material.

39. A method as set forth in claim 23 wherein at least one groove is disposed in the support member.

40. A member as set forth in claim 31 wherein a compliant material at least partially fills the at least one groove in the support member.

41. A method as set forth in claim 23 wherein compliant material is disposed within the cylindrical configuration of the transducer member.

42. A method as set forth in claim 41 wherein the transducer member has a cylindrical configuration and wherein openings are provided in the compliant material within the cylindrical configuration of the transducer member.

43. A method as set forth in claim 23 wherein the transducer constitutes a first transducer and wherein a second transducer having a smaller size than the first transducer is disposed within the first transducer in a substantially concentric relationship with the first transducer and wherein the first and second transducers are attached to each other to maintain the substantially concentric relationship between the transducer and wherein the alternating voltage is applied to the second transducer.

44. A method as set forth in claim 23 wherein a second support member having a smaller size than the support member in the transducer is disposed within the transducer in a substantially concentric relationship with the transducer and wherein the second support member is attached to the support member in the transducer to maintain the support members in the substantially concentric relationship.

45. A method as set forth in claim 23 wherein the transducer constitutes a first transducer and the transducer member constitutes a first transducer member and the support member constitutes a first support member and wherein a second transducer has a second transducer member and a second support member corresponding in construction to the construction of the first transducer member and the first support member in the first transducer and wherein the first and second transducers are attached to each other in a substantially planar relationship and wherein the alternating voltage is applied to the second transducer member.

46. A method as set forth in claim 45 wherein the second transducer member and the second support member have gaps corresponding to the gaps in the first transducer member and the first support member and wherein the first and second transducers are attached to each other in the coplanar relationship with the gaps in the first transducer member and the first support member contiguous to the gaps in the second transducer member and the second support member.

47. A method as set forth in claim 46 wherein the transducer constitutes a first transducer and wherein a second transducer corresponding to the first transducer is provided and wherein the first and second transducers are disposed in a substantially parallel relationship in planes displaced from each other and wherein the alternating voltage is applied to the second transducer.

48. A method as set forth in claim 46 wherein the transducer constitutes a first transducer and wherein a second transducer corresponding to the first transducer is provided and wherein the first and second transducers are disposed in a substantially parallel relationship in planes displaced from each other and wherein the alternating voltage is applied to the second transducer.

49. A method as set forth in claim 47 wherein the first and second transducers are disposed in a tubing and are attached to the tubing to maintain the transducer in the substantially parallel relationship in the displaced planes.

50. A method as set forth in claim 47 wherein the first and second transducers are disposed in a tubing and are attached to the tubing to maintain the transducer in the substantially parallel relationship in the displaced planes.

51. A method as set forth in claim 45 wherein the second transducer member and the second support member have gaps respectively corresponding to the gaps in the first transducer member and the first support member and wherein the first and second transducers are attached to each other in the coplanar relationship with the gaps in the first transducer member and the first support member contiguous to the gaps in the second transducer member and the second support member.

52. A method as set forth in claim 23 wherein the transducer is resonant at the particular frequency when it is not disposed in the earth and wherein the transducer has a high mechanical Q at the particular frequency and wherein the transducer develops harmonics and overtones of the particular frequency when the transducer is disposed in the earth and wherein some of the harmonics and the overtones develop more output power than the particular frequency when the transducer is disposed in the earth.

53. A method as set forth in claim 23 wherein the transducer is disposed in earth having oil distributed through the earth and wherein the alternating voltage at the fundamental frequency is applied to the transducer with the transducer disposed in the earth and wherein sound pressure waves with higher amplitudes are produced in the transducer at harmonics and overtones of the fundamental frequency than the amplitude of the sound pressure waves at the fundamental frequency to obtain a recovery of the oil from the earth.

54. A method as set forth in claim 23 wherein the transducer member is formed from a plurality of sectionalized transducer elements attached to the circumferential inner surface of the support member.

55. A method as set forth in claim 23 wherein the transducer member is formed from a plurality of radially disposed sectionalized transducer elements and wherein the sectionalized transducer elements disposed in the plurality at the outer radial ends of the transducer member are attached to the support member at positions equally spaced from the gap in the support member.

56. A method as set forth in claim 23 wherein a closure member made from a resilient material is provided with an opening at one end and is closed at the other end and wherein the closure member is attached at the open end to the support member at the position of the gap in the support member and wherein the closure member is disposed at its closed end in the space within the cylindrical configuration of the transducer member.

57. A method as set forth in claim 23 wherein sockets are disposed in the support member.

58. A method as set forth in claim 57 wherein at least some of the sockets are at least partially filled with a compliant material.

59. A method as set forth in claim 23 wherein at least one groove is disposed in the support member.

60. A member as set forth in claim 59 wherein a compliant material at least partially fills the at least one groove in the support member.

61. A method as set forth in claim 23 wherein compliant material is disposed within the cylindrical configuration of the transducer member.

62. A method as set forth in claim 61 wherein openings are provided in the compliant material within the cylindrical configuration of the transducer member.

63. A method as set forth in claim 23 wherein the transducer constitutes a first transducer and wherein a second transducer having a smaller size than the first transducer is disposed within the first transducer in a substantially concentric relationship with the first transducer and wherein the first and second transducers are attached to each other to maintain the substantially concentric relationship between the transducers and wherein the alternating voltage is applied to the second transducer.

64. A method as set forth in claim 23 wherein a second support member having a smaller size than the support member in the transducer is disposed within the transducer in a substantially concentric relationship with the transducer and wherein the second support member is attached to the support member in the transducer to maintain the support members in the substantially concentric relationship.

65. A method as set forth in claim 23 wherein the transducer constitutes a first transducer and the transducer member constitutes a first transducer member and the support member constitutes a first support member and wherein a second transducer has a second transducer member and a second support member corresponding in construction to the construction of the first transducer member and the first support member in the first transducer and wherein the first and second transducers are attached to each other in a substantially planar relationship and wherein the alternating voltage is applied to the second transducer member.

66. A transducer, including a piezoelectric member having a hollow substantially looped configuration and having a gap in the hollow substantially looped configuration and having properties of vibrating in accordance with the introduction of an alternating voltage to the piezoelectric member, a support member having a substantially looped configuration and disposed on the piezoelectric member and covering the substantially looped configuration and disposed on the piezoelectric member and covering the substantially looped configuration of the piezoelectric member and having properties of vibrating with the piezoelectric member, and a source of an alternating voltage having a fundamental frequency in one of the sub-sonic and sonic ranges and rich in harmonics, the alternating voltage source being connected to the piezoelectric member to produce a vibration of the piezoelectric member and the support member.

67. A transducer as set forth in claim 66 wherein the source introduces a square wave alternating voltage to the piezoelectric member.

68. A transducer as set forth in claim 66 wherein the combination of the piezoelectric member and the support member has a particular resonant frequency and wherein the fundamental frequency of the alternating voltage corresponds to the particular resonant frequency.

69. A transducer as set forth in claim 66 wherein the earth has at different positions characteristics affecting the frequency at which the transducer resonates and wherein the characteristics of the alternating voltage rich in harmonics cause harmonics and overtones of the fundamental frequency to be produced with amplitudes providing a recovery of the oil from the earth.

70. A transducer as set forth in claim 66 wherein the piezoelectric member is provided with a substantially uniform thickness throughout its annular periphery and the support member is provided with a substantially uniform thickness throughout its annular periphery.

71. A transducer as set forth in claim 66 wherein the piezoelectric member is provided with a substantially uniform thickness throughout its annular periphery and the support member is provided with a progressively increasing thickness at progressive distances in opposite directions from the gap.

72. A transducer as set forth in claim 66 wherein the combination of the piezoelectric member and the support member is resonant at a particular frequency and wherein the fundamental frequency of the source is substantially the particular frequency.

73. A transducer as set forth in claim 72 wherein the server introduces a squarewave alternating voltage to the piezoelectric member.

74. A transducer as set forth in claim 66 wherein the combination of the piezoelectric member and the support member has a high mechanical Q.

75. A method as set forth in 66 wherein the transducer is resonant at a frequency of approximately 200 hertz and the fundamental frequency of the voltage source is approximately 200 hertz.

* * * * *